US010465271B2

(12) United States Patent
Adam et al.

(10) Patent No.: US 10,465,271 B2
(45) Date of Patent: Nov. 5, 2019

(54) METHOD OF FORMING PARTS FROM SHEET METAL ALLOY

(71) Applicants: IMPERIAL INNOVATIONS LIMITED, London (GB); IMPRESSION TECHNOLOGIES LIMITED, Coventry (GB)

(72) Inventors: George Adam, Coventry (GB); Daniel Balint, London (GB); Trevor Dean, Birmingham (GB); John Dear, Keston (GB); Omer El Fakir, Istanbul (TR); Alistair Foster, Coventry (GB); Jianguo Lin, London (GB); Liliang Wang, London (GB)

(73) Assignees: IMPERIAL INNOVATIONS LIMITED, London (GB); IMPRESSION TECHNOLOGIES LIMITED, Coventry (GB)

( * ) Notice: Subject to any disclaimer, the term of this patent is extended or adjusted under 35 U.S.C. 154(b) by 0 days.

(21) Appl. No.: 15/126,196

(22) PCT Filed: Mar. 13, 2015

(86) PCT No.: PCT/GB2015/050737
§ 371 (c)(1),
(2) Date: Sep. 14, 2016

(87) PCT Pub. No.: WO2015/136299
PCT Pub. Date: Sep. 17, 2015

(65) Prior Publication Data

US 2017/0081748 A1 Mar. 23, 2017

(30) Foreign Application Priority Data

Mar. 14, 2014 (GB) ..... 1404650.2
Feb. 26, 2015 (GB) ..... 1503238.6

(51) Int. Cl.
*C22F 1/04* (2006.01)
*C22F 1/047* (2006.01)
*C22F 1/05* (2006.01)

(52) U.S. Cl.
CPC ..... *C22F 1/047* (2013.01); *C22F 1/04* (2013.01); *C22F 1/05* (2013.01)

(58) Field of Classification Search
None
See application file for complete search history.

(56) References Cited

U.S. PATENT DOCUMENTS 3,615,926 A * 10/1971 Taylor ..... C21D 1/64 148/320
5,266,130 A * 11/1993 Uchida ..... C22F 1/047 148/415

(Continued)

FOREIGN PATENT DOCUMENTS

CN 1780926 A 5/2006
CN 102304612 A 1/2012

(Continued)

OTHER PUBLICATIONS

International Search Report and Written Opinion of the International Searching Authority for Application No. PCT/GB2015/050737, dated Oct. 9, 2015, 9 pages.

(Continued)

*Primary Examiner* — George Wyszomierski
(74) *Attorney, Agent, or Firm* — Meunier Carlin & Curfman LLC

(57) ABSTRACT

A method of forming a part from sheet metal alloy is provided, for example, forming a part from aluminium alloy. The method comprises heating (A) the sheet metal alloy to a temperature at which solution heat treatment of the alloy occurs and so as to achieve solution heat treatment. The sheet is cooled (B) at least the critical cooling rate for the (Continued)

alloy and then placed between dies to form (C) it into or towards the part.

19 Claims, 6 Drawing Sheets

(56) References Cited

U.S. PATENT DOCUMENTS

| | | | | |
|---|---|---|---|---|
| 5,525,169 | A * | 6/1996 | Murtha | C22C 21/02 148/417 |
| 2006/0151075 | A1 | 7/2006 | Van Der Veen et al. | |
| 2012/0186706 | A1 | 7/2012 | Krajewski | |
| 2014/0308157 | A1* | 10/2014 | Yamakawa | C22F 1/06 420/407 |
| 2015/0101718 | A1* | 4/2015 | Harrison | C22C 21/10 148/701 |
| 2015/0125713 | A1* | 5/2015 | Harrison | C22F 1/04 428/594 |
| 2015/0217813 | A1* | 8/2015 | Smeyers | B32B 15/016 428/654 |

FOREIGN PATENT DOCUMENTS

| | | | |
|---|---|---|---|
| CN | 102912267 | A | 2/2013 |
| DE | 102010045025 | A1 | 5/2011 |
| DE | 102012001020 | A1 | 8/2012 |
| DE | 102012007213 | A1 | 11/2012 |
| JP | 2005-105308 | A | 4/2005 |
| JP | 2011-252212 | A | 12/2011 |
| JP | 2012-107316 | A | 6/2012 |
| WO | 2010032002 | A1 | 3/2010 |

OTHER PUBLICATIONS

First Office Action and Search Report issued by the State Intellectual Property Office for the People's Republic of China in connection with Chinese Application No. 201580018712.9, dated Jul. 4, 2017.

Third Party Observation pursuant to Article 115 EPC, issued by the European Patent Office in connection with European Application No. 15753738.2, dated Nov. 13, 2017 (5 pages).

Second Office Action issued by the State Intellectual Property Office for the People's Republic of China in connection with Chinese Application No. 201580018712.9, dated Jun. 12, 2018.

Examination Report issued by the European Patent Office in connection with European Application No. EP15753738.2, dated Jul. 9, 2018.

First Office Action issued by the Japan Patent Office in corresponding Japanese Patent Application No. JP2016-574506, dated Dec. 4, 2018.

English Translation of Chinese Office Action for CN Application No. 201580018712.9; dated Feb. 12, 2019; 14 pages.

* cited by examiner

METHOD OF FORMING PARTS FROM SHEET METAL ALLOY

FIELD

The present invention relates to the forming of parts from sheet metal alloy. In embodiments, it relates to the forming of parts from aluminium alloy.

BACKGROUND

It is generally desirable that components used in automotive and aerospace applications be manufactured from as few parts as is compatible with the final use of those components. One method of manufacturing parts which meets this requirement is to form a single sheet of metal into a part using a die set. The complexity of shape of parts which can be formed in this way is, however, limited by the mechanical properties of the sheet metal which is formed in the die set. On the one hand, it may be too brittle; on the other, it may be too ductile. In either case, formability would be limited. Previously, the present inventors discovered that solution heat treating a sheet of metal and then rapidly forming it into a part in a cold die set improves the formability of the metal, allowing more complex-shaped components to be manufactured from a single sheet. Such components therefore no longer need to be formed as a multi-part assembly.

This process is disclosed in WO 2010/032002 A1, which discloses a method of forming aluminium alloy sheet components, using a solution heat treatment, cold die forming and quenching (HFQ (RTM)) process. The temperature of a sheet of metal alloy as it goes through such a process is shown in FIG. 1. Essentially, this existing HFQ (RTM) process involves the following steps:

(A) preheating a sheet metal workpiece to, or above, the solution heat treatment (SHT) temperature range of the metal;

(B) soaking the workpiece at the preheat temperature to enable the material to be fully solution heat treated;

(C) transferring the workpiece to a cold die set and forming quickly at the highest possible temperature and at a high forming speed;

(D) holding the formed part in the cold die set for rapid cooling (cold die quenching) to achieve a super saturated solid solution (SSSS) material microstructure, desirable for post-form strength; and (E) artificial or natural ageing of the formed part to obtain an improved strength for heat treatable materials.

At stage C, the workpiece is formed at a temperature close to the SHT temperature to enable the high ductility of the material to be employed in the forming of the part. At this high temperature, the workpiece is very soft, ductile and easy to deform. While this method therefore has certain advantages over earlier methods, including enabling the forming of parts which are complex in shape (complex parts) with SSSS microstructures desirable for high post-form strength, it also has certain drawbacks. These will now be described.

The workpiece is weak when it is near its SHT temperature. During forming of complex parts, certain areas of the workpiece are constrained by the die, while the others are forced to flow over the die. The flow of material from the areas which are held still in the die to the areas which are being stamped is restricted. This can result in localized thinning and tearing of the workpiece. This is because the forming process benefits less from the effect of strain hardening, which is weaker at higher temperatures particularly in the case of aluminium alloys. Strain hardens the metal so that areas of the workpiece which have been deformed become harder and hence stronger. This increases the ability of these deformed areas to pull other material in the region and draw that material into the die. The drawn in metal is itself strained and thus is hardened. This straining and hardening throughout a sheet inhibits localised thinning and leads to more uniform deformation. The greater the strain hardening, the greater the tendency to uniform deformation. With only weak strain-hardening, deformation is localized in areas of high ductility and draw-in is restricted, and so the incidence of localized thinning and failure may therefore increase. This degrades formability. To increase formability and strength in this process, the workpiece is formed in the dies at a very high speed in order to compensate for the weaker strain hardening at high temperatures by maximizing the effect of strain rate hardening.

The requirement for a high temperature to increase ductility and a high forming speed to increase strain hardening and strain rate hardening can lead to the following problems:

(i) A large amount of heat is transferred to the die set from the workpiece. As the forming process requires that the dies remain at a low temperature to achieve the quenching rate required to obtain a SSSS microstructure, they have to be artificially cooled, on the surface or by internal coolant-carrying channels (or otherwise). Repeated thermal cycles can lead to quicker degradation and wear of the dies.

(ii) For the mass-production of HFQ formed parts, the requirement that the dies be cooled complicates design, operation and maintenance of the dies, and increases die set cost.

(iii) The holding pressure and time in the die are higher, as the formed part has to be held in between the dies until it is cooled to the desired temperature. This uses more energy than processes with lower forming times and pressures and reduces forming efficiency and thus productivity.

(iv) The high forming speed can cause significant impact loads when the dies are closed during forming. Repeated loading can lead to damage and wear of the dies. It can also necessitate the use of high durability die materials, which increases the die set cost.

(v) Specialized high speed hydraulic presses are required for the process to provide the die closing force. These hydraulic presses are expensive, which limits application of HFQ processes.

It would be desirable to address at least some of these problems with existing HFQ processes.

SUMMARY

According to a first aspect of this invention, there is provided a method of forming a part from sheet metal alloy, the method comprising the steps of:

(a) heating the sheet to a temperature at which solution heat treatment of the alloy occurs and so as to achieve solution heat treatment;

(b) cooling the sheet at at least the critical cooling rate for the alloy; and then (c) placing the sheet between dies to form it into or towards the complex part.

[Materials]

The sheet may be of an aluminium alloy. The sheet may be of AA5XXX alloy. The sheet may be of AA6XXX alloy. The sheet may be of AA7XXX alloy. It may be of aluminium alloy 6082. The sheet may be of a magnesium alloy. It may be of a titanium alloy. The sheet may be of any alloy which requires solution heat treatment before forming. The sheet may be of tempered alloy. The sheet may be of untempered alloy. The sheet may be of annealed alloy.

[Step (a)]

[SHT Temperature]

The temperature to which the sheet is heated in step (a) will depend on the alloy and on the application of the finished part. There is a range of temperatures at which solution heat treatment (SHT) can be achieved. The lower end of that range may be the solvus temperature for the alloy. The solvus temperature may be defined as the temperature at which alloying elements in the sheet which will precipitate go into solution or start to go into solution. The upper end of that range may be the solidus temperature for the alloy. The solidus temperature may be defined as the temperature at which alloying elements in the sheet precipitate. Step (a) may comprise heating the sheet to at least the temperature at which precipitates in the alloy are dissolved. When the sheet metal alloy is aluminium alloy 6082, step (a) may comprise heating the sheet to between 520° C. and 575° C. (575° C. is the solidus temperature of aluminium alloy 6082). When the sheet metal alloy is aluminium alloy 6082, step (a) may comprise heating the sheet to between 520° C. and 565° C. When the sheet metal alloy is aluminium alloy 6082, step (a) may comprise heating the sheet to between 520° C. and 540° C. When the sheet metal alloy is tempered aluminium alloy 6082, step (a) may comprise heating the sheet to 525° C. When the sheet metal alloy is an AA5XXX alloy, step (a) may comprise heating the sheet to between 480° C. and 540° C. When the alloy is an AA7XXX alloy, step (a) may comprise heating the sheet to between 460° C. and 520° C.

[Soaking]

Step (a) may comprise heating the sheet to a temperature within a range of temperatures at which solution heat treatment of the alloy occurs and maintaining it within this temperature range for at least 15 seconds. When the sheet is of tempered metal alloy, step (a) may comprise maintaining the sheet within this temperature range for between 15 and 25 seconds. When the sheet is of tempered metal alloy, step (a) may comprise maintaining the sheet within this temperature range for at least one minute. When the sheet is of untempered metal alloy, step (a) may comprise maintaining the sheet within this temperature range for at least five minutes. Maintaining the sheet within its solution heat treatment temperature range dissolves alloying elements into the metal matrix.

[Effects]

By solution heat treating the sheet before it is formed, higher ductilities can be attained than in a process without the SHT step.

[Step (b)]

The method differs from the process described in WO 2010/032002 A1 section in at least that it includes the step (b) of cooling the sheet at at least the critical cooling rate for the alloy, after heating the sheet to a temperature at which solution heat treatment (SHT) occurs, before placing the sheet between the dies.

[Rate of Cooling]

The critical cooling rate of step (b) differs according to the alloy. Step (b) may comprise cooling the sheet at at least the rate at which microstructural precipitation in the alloy is avoided. Cooling at or above the critical cooling rate avoids the formation of coarse precipitates at grain boundaries which can reduce the post-form strength. When the sheet metal alloy is an aluminium alloy with a first mass fraction of Mg and Si, step (b) may comprise cooling the sheet at at least 10° C. per second. Step (b) may comprise cooling the sheet at at least 20° C. per second. When the sheet metal alloy is an aluminium alloy with a second mass fraction of Mg and Si, higher than the first mass fraction of Mg and Si, step (b) may comprise cooling the sheet at at least 50° C. per second. When the sheet metal alloy is Aluminium alloy 6082 cooling at at least this rate avoids coarse precipitation in the metal. Step (b) may comprise measuring the temperature of the sheet at one or more positions on the sheet. The temperature or temperatures may be measured continuously or at intervals. Step (b) may comprise controlling the rate of cooling of the sheet based on the measured temperature or temperatures.

[Duration of Cooling]

Step (b) may comprise cooling the sheet for less than 10 seconds. Step (b) may comprise cooling the sheet for less than 5 seconds. Step (b) may comprise cooling the sheet for less than 3 seconds. Step (b) may comprise cooling the sheet for less than 2 seconds. Step (b) may comprise cooling the sheet for less than 1 second. Step (b) may comprise cooling the sheet for less than 0.5 seconds. Step (b) may comprise cooling the sheet for less than 0.1 seconds. When the sheet metal alloy is AA6082, step (b) may comprise cooling the sheet for between 1 second and 3 seconds.

[Target Temperature]

Step (b) may include cooling the sheet until a target temperature is reached. The step (b) of cooling the sheet may comprise cooling the whole sheet to substantially the same temperature.

The target temperature to which the sheet is cooled before step (c) depends on the shape of the part to be formed, the material from which it is formed and the mechanical properties required of the finished part. The sheet may be cooled to the lowest temperature that still allows forming of the part. The sheet may be cooled to the lowest temperature that still allows forming of the part such that it has desirable characteristics.

For example, if the sheet is cooled to too low a temperature, unacceptable spring-back may occur. The sheet may be cooled to the lowest temperature that allows the part to withstand the maximum strain that it will experience during forming without failure. The sheet may be cooled to between 50° C. and 300° C. The sheet may be cooled to between 100° C. and 250° C. The sheet may be cooled to between 150° C. and 200° C. The sheet may be cooled to between 200° C. and 250° C. When the sheet is formed from aluminium alloy 6082, the sheet may be cooled to between 200° C. and 300° C. When the sheet is formed from aluminium alloy 6082, the sheet may be cooled to 300° C.

[Means of Cooling]

It is envisaged that the cooling of the sheet is by some artificial means, rather than just by ambient, still, air. Step (b) may comprise applying a cooling medium to the sheet. Step (b) may comprise directing a cooling medium at the heated sheet.

[Cooling by a Fluid]

The cooling medium may be a fluid. The fluid may be a gas, for example air. The fluid may be a liquid, for example water. The fluid may comprise gas and liquid, for example air and water. The fluid may be directed as a pressurised flow of the fluid. The fluid may be directed as a jet. The fluid may be directed as a mist spray. The fluid may be directed with a duration, temperature and/or mass flow such that the sheet is cooled at at least the critical cooling rate for the alloy.

[Cooling by a Solid]

The cooling medium may be a solid with a thermal conductivity higher than air. The cooling medium may be a solid with a thermal conductivity higher than water. The solid may be applied with a pressure and/or duration such that the sheet is cooled at at least the critical cooling rate for the alloy. The solid may be a copper transfer grip. The solid may be a quenching block. The solid may be a conductive plate. The solid may comprise retractable rollers arranged to facilitate positioning the sheet on the block. The solid may comprise a surface arranged at least partially to contact the sheet, the surface defining at least one opening arranged to be connected to a vacuum unit so that the pressure in the at least one opening is less than atmospheric pressure. In this way, the sheet can be held on the solid by the negative gauge pressure in the at least one opening. The solid may comprise a bimetallic strip arranged to lift at least partially the sheet from the solid when the strip reaches a temperature to which the sheet is to be cooled before step (c). A load may be applied to the solid to increase the pressure of the solid on the sheet.

[Convective Cooling]

Step (b) may comprise transferring the sheet to a temperature-controlled chamber. The temperature-controlled chamber may be arranged to cool the sheet at at least the critical cooling rate of the alloy. The temperature-controlled chamber may be at a temperature below 300° C. The temperature-controlled chamber may be at a temperature of or below 250° C. The temperature-controlled chamber may be at a temperature of or below 200° C.

The temperature-controlled chamber may be at a temperature of or below 150° C. The temperature-controlled chamber may be at a temperature of or below 100° C. The temperature-controlled chamber may be at a temperature of or below 50° C. Step (b) may comprise maintaining the sheet to a temperature-controlled chamber until a target temperature is reached.

[Non-Uniform Cooling]

The step (b) of cooling the sheet may comprise selectively cooling at least one area of the sheet to a different temperature from the remainder of the sheet. Step (b) may comprise selectively cooling at least a first area of the sheet to a first temperature which is lower than a second temperature, to which at least a second area of the sheet is cooled. In other words, the cooling may be non-uniform. In this way, the temperature to which the at least first and second areas are cooled may be selected according to the complexity of the geometry of the dies in those areas. For example, the first area cooled to the first temperature may be an area of the sheet in which a higher strength is required than in the second area to prevent localised thinning from occurring. The temperature to which the at least first and second areas are cooled may be selected according to the forces these areas will experience in the die, or may be selected according to the forces these areas will experience in use once formed. The temperature to which the at least first and second areas are cooled may be selected to provide for controlled failure of a part formed from the workpiece. The first area cooled to a first temperature may be an area of the sheet which is thicker than the second area cooled to the second temperature. Step (b) may comprise selectively cooling at least one area of the sheet to a different temperature from at least a second area of the sheet such that the finished part has at least one area of reduced strength and/or increased ductility relative to the at least one second area of the sheet. This can provide for controlled failure of the finished part under crash conditions.

[Non-Uniform Cooling by a Fluid]

When the cooling is non-uniform and a cooling fluid is directed at the heated sheet, the fluid may be directed with a longer duration, lower temperature and/or greater mass flow to the first area of the sheet to cool it to a first temperature which is lower than a second temperature to which at least a second area of the sheet is cooled.

[Non-Uniform Cooling by a Solid]

When the cooling is non-uniform and a solid with a thermal conductivity higher than air is applied to the sheet, step (b) may comprise selectively cooling at least a first area of the sheet to a first temperature which is lower than a second temperature to which at least a second area of the sheet is cooled by applying the solid with greater pressure to the first area than to the second area.

The solid may comprise a surface arranged to be in contact with the sheet, at least one first area of that surface being in relief relative to at least one second area. In this way, when the solid is applied to the sheet, the at least one first area contacts the sheet with greater pressure than the at least one second area. Step (b) may comprise selectively cooling at least a first area of the sheet to a first temperature which is lower than a second temperature to which at least a second area of the sheet is cooled by applying the solid to the first area and not to the second area. The solid may comprise a surface arranged at least partially to contact the sheet. That is, at least part of the surface may be arranged to contact at least part of the sheet. The surface may be formed of a first material having a first thermal conductivity and a second material having a second thermal conductivity which is lower than the first thermal conductivity. In this way, when the surface is in contact with the sheet, the first material will cool the sheet more rapidly than the second material.

When the solid comprises a surface arranged to contact the sheet, the surface defining at least one opening arranged to be connected to a vacuum unit so that the pressure in the at least one opening is less than atmospheric pressure, step (b) may comprise operating the vacuum unit to impose a first pressure in a first opening which is lower than a second pressure in a second opening, the first and second pressures less than atmospheric pressure. In this way, an area of the sheet adjacent the first opening will be drawn to the sheet with more force than an area of the sheet adjacent a second opening, so that the first area is cooled by the solid more quickly than the second.

[Where Cooled]

Step (b) may comprise cooling the sheet on a surface at a cooling station. The cooling station may form part of an apparatus arranged to transfer the sheet to the dies. Step (b) may comprise cooling the sheet while the sheet is being transferred to the dies. It may comprise cooling the sheet while the sheet is held in a grip for transferring the sheet from a furnace to the dies. Step (b) may comprise cooling the sheet in the dies. When step (b) comprises cooling the sheet in the dies, the dies may be arranged to direct fluid at the sheet. The fluid may be used to clean the dies.

[Effects]

By cooling the sheet at at least the critical cooling rate for the alloy (after heating the sheet to within its SHT temperature range and before placing the sheet between the dies) microstructural precipitation in the alloy is avoided, and the sheet is cooler when it is placed in the dies than in a process without the cooling step (b). The sheet can therefore be formed at a lower temperature than in the existing HFQ (RTM) method described in WO 2010/032002 A1. Since the sheet is formed at a lower temperature, its strength will be higher and the strain hardening effect greater, facilitating greater material draw-in. In other words, the strain hardening effect causes the deformation of the sheet to be more uniform, with a deformed area becoming stronger, causing deformation to occur in other areas, which in turn become stronger. This reduces the likelihood of localized thinning, enhancing formability of the sheet. The introduction of the cooling step (b) to the existing HFQ (RTM) process thus allows the benefits of HFQ (RTM) forming to be further enhanced while mitigating its drawbacks.

The feature of cooling the sheet at at least the critical cooling rate for the alloy thus increases the strength of the formed part, while maintaining sufficient ductility of the sheet to allow it to be formed.

[Step (c)]

In the step (c) of placing the sheet between dies to form it into or towards the complex part, the dies may be shaped to account for local thinning of the sheet. In other words, surfaces of the dies arranged to contact the sheet may be shaped to follow the thickness contours of the formed part. The dies may be cold dies. The dies may be cooled. Thus, the sheet may be further quenched in the dies.

[Effects]

By forming the sheet in cold dies, the problems of warm forming of low cost-effectiveness (due to heating of the sheet and the die set), and of the possibility of microstructure destruction of the workpiece (degrading post-form strength), are avoided.

[Applications]

The method may be a method of forming complex parts. The method may be a method of forming parts for automotive applications. The method may be a method of forming parts for aerospace applications. The method may be a method of forming panel parts for aerospace applications. The method may be a method of forming interior structural sheet components, load-bearing parts, or parts adapted to bear load in static or moving structures.

BRIEF DESCRIPTION OF THE DRAWINGS

Specific embodiments of the invention are described below by way of example only and with reference to the accompanying drawings, in which:

FIG. 2(*b*) shows a comparison of the mechanical behaviour of the metal at 300° C. with and without prior SHT, to simulate the effect of step (b), in addition to the behaviour of the metal at 450° C. with prior SHT, to simulate the conventional HFQ (RTM) process;

SPECIFIC DESCRIPTION OF CERTAIN EXAMPLE EMBODIMENTS

Figure 1:
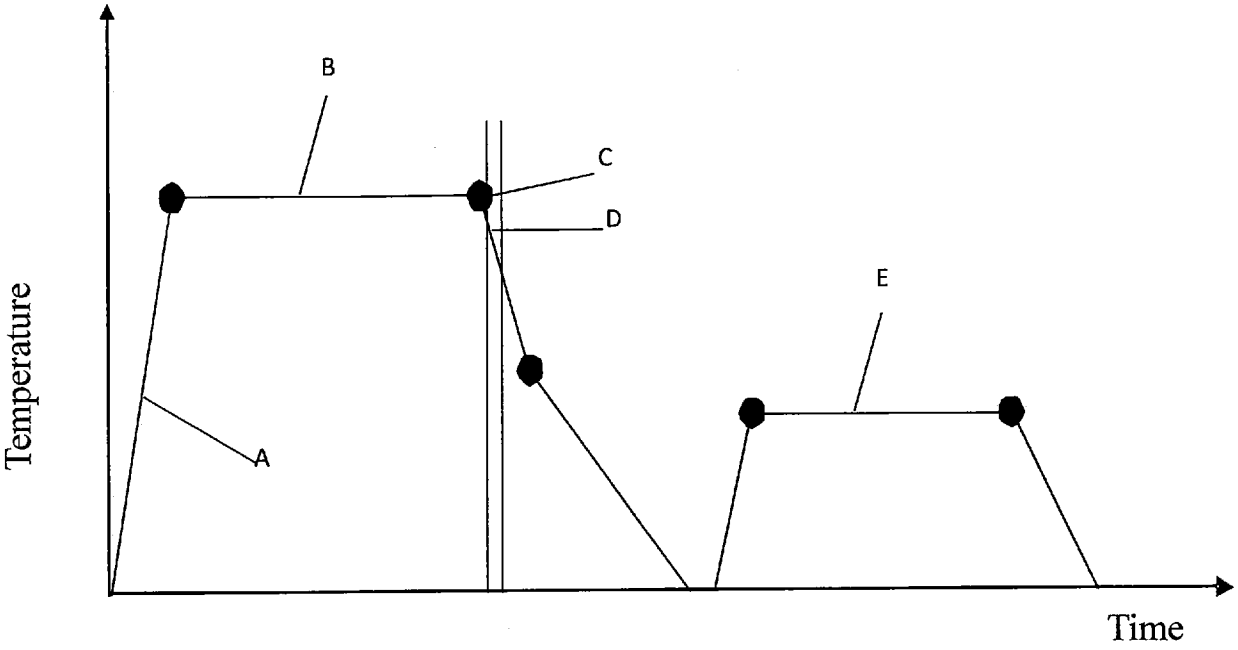
FIG. 1 is a graph showing the temperature of a sheet of metal alloy as it goes through an existing HFQ (RTM) process.

A graph of workpiece temperature against time for the solution heat treatment, cold die forming and quenching (HFQ (RTM)) method described in WO 2010/032002 A1 is shown in FIG. 1. Briefly, this method involves heating a sheet metal workpiece to, or above, its SHT temperature; soaking it at this temperature; transferring it to a cold die set; and rapidly forming it into the part shape. The formed part is then quenched in the dies, and then is artificially or naturally aged. As discussed above, an important consideration in this existing method is that the sheet metal alloy be as close to its SHT temperature as possible when it is formed.

By contrast, the method that will now be described, and which amounts to an embodiment of the present disclosure, includes an additional step of cooling the sheet at at least the critical cooling rate for the alloy, before it is placed in the dies.

Figure 3:
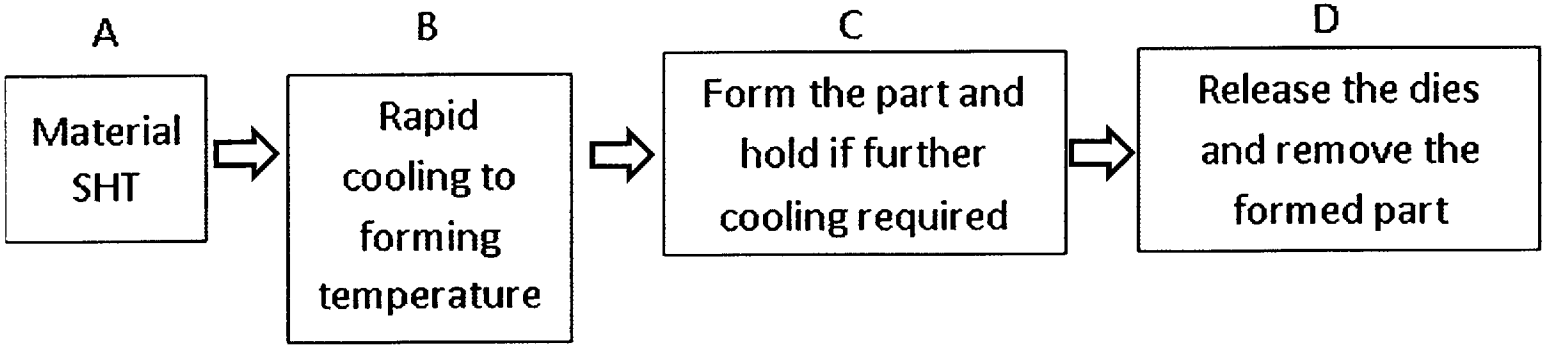
FIG. 3 shows a process diagram for an embodiment of a method of forming a complex part from sheet metal alloy.

With reference now to FIG. 3, the method, which is a method of forming a complex part from sheet metal alloy, which in this embodiment is a sheet of tempered AA6082 (the "workpiece"), involves, in overview the following steps: solution heat treating (A) the workpiece; rapidly cooling it (B) to the temperature at which it is to be formed; forming (C) in dies a part from the workpiece, and further quenching it in the dies; and releasing (D) the dies and removing the formed part.

With continued reference to FIG. 3, each of these steps is now described in more detail.

[Step (A)]

Step (A) involves solution heat treatment of the workpiece. The workpiece is heated to a temperature at which solution heat treatment of the alloy occurs. In this embodiment, it is heated to 525° C. A furnace is used to heat the workpiece, although in other embodiments other heating stations may conceivably be used, for example, a convection oven. The workpiece is soaked at this temperature to dissolve as much of the alloying elements into the aluminium matrix as practicable. This enables the workpiece to be fully solution heat treated. In this embodiment, the workpiece is soaked for between 15 and 25 seconds. The temperature and time will, however, vary according to a number of factors, discussed below.

The temperature and time selected depend on the alloy series.

The temperature and time will also depend on whether or not the workpiece has been tempered. In this embodiment, as mentioned above, the workpiece has been tempered. In embodiments in which the workpiece has not been tempered (for example, in embodiments where the method of forming a complex part is conducted on sheet metal alloy after rolling the sheet, or after annealing the sheet) the solution heat treatment is accomplished by maintaining the workpiece within the temperature range for longer than the 15 to 25 seconds used for the workpiece of tempered aluminium alloy 6082 of the embodiment described above. For example, in certain embodiments, the workpiece is held within the temperature range for at least 1 minute, and in others, it is held within the temperature range for at least 10 minutes.

The soaking time also depends on the temperature selected and on the rate of heating towards that temperature. Depending on the alloy, soaking at a higher temperature for a short time may cause a drop in final mechanical properties of the part such as ductility at room temperature, compared with SHT at a lower temperature for a longer time. Heating to a high temperature for a shorter time, however, increases the speed with which parts can be formed using this process. AA6082 (the alloy of the present embodiment), contains additions to stop grain growth. It can therefore be heated for a shorter time at a higher temperature, without compromising the mechanical properties of the finished part. In other embodiments, therefore, the workpiece is heated to a temperature higher than 525° C., for example, 560° C. In embodiments where heating to the final desired temperature takes longer than in this described embodiment, additional soaking is unnecessary. For example, heating the workpiece to 560° C. in a convection oven can take around ten minutes. Where this is the case, the workpiece is not held at this temperature, since SHT has been achieved during the heating phase.

In some embodiments, the workpiece does not need to be soaked at all, since SHT may be achieved as the workpiece is heated towards a final temperature.

[Step (B)]

[Uniform Cooling]

At step (B), the workpiece is cooled to the temperature at which it is to be formed. In this embodiment, the workpiece is cooled uniformly to 300° C. The temperature to which the blank is cooled and the time for which it is cooled depend on the thickness of the workpiece, as well as the particular cooling method used. The mechanical properties of the workpiece metal at different temperatures and/or strain rates can be characterized using advanced material testing techniques. Advanced material modelling and finite element (FE) modelling are used to predict the forming limits of the material at specified forming conditions. The most appropriate forming parameters are selected based on the modelling predictions. In some embodiments, FE models of the forming process also help identify the maximum strain levels in a part, and a temperature and cooling time that enable these strains to be achieved is selected. For example, in an alternative embodiment in which the workpiece is of AA6082 and is 2 mm thick, the workpiece is cooled to 350° C. and the cooling time is between around 1 and 3 seconds.

Figure 5:
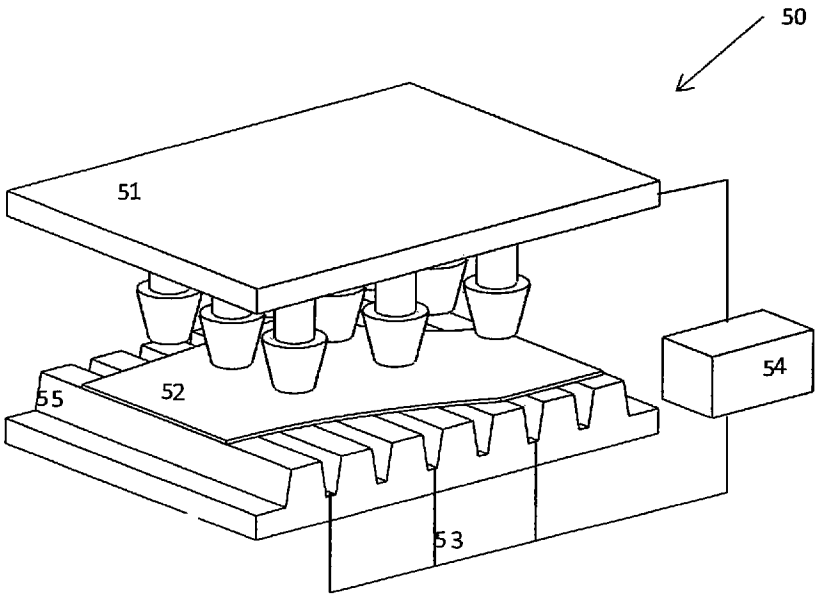
FIG. 5 shows a workpiece at a cooling station with an assembly of nozzles for cooling the workpiece with a mist of air and water.

With reference now to FIG. 5, in this embodiment, the workpiece (52) is cooled at a cooling station (50) on a production line (not shown) between the furnace and the dies (also not shown) as part of a system (not shown) transferring the workpiece (52) between the furnace and the dies. At the cooling station (50), the workpiece (52) is placed on a surface of a workpiece holding unit (55) and cooled by a mist of air and water. Pressurised water is released as a fine spray from an assembly (51) of nozzles. The number of nozzles used is selected according to the rate of cooling required and the size of the component. When cooling of the entirety of a large workpiece is required at a high rate, then the required number of nozzles is greater than, for example, the number of nozzles required to cool a small workpiece at a lower rate.

The workpiece is cooled at at least the critical cooling rate for the alloy, that is, at a rate that avoids unwanted formation and growth of precipitates, but maintains high ductility. In this embodiment, a cooling rate of 50° C. per second achieves this effect. For other alloys, the critical cooling rate for the alloy will be different.

A control loop is used to monitor and adjust the cooling of the workpiece (52). The temperature of the workpiece (52) is measured by thermocouples (53). The mass flow of the spray of pressurised water from the assembly (51) of nozzles is controlled by a flow control unit (54). The flow control unit (54) compares the temperatures measured by thermocouples (53) with reference temperatures (that is, temperatures defining a rate of cooling that avoids unwanted formation and growth of precipitates, but maintains high ductility). The flow control unit (54) increases the mass flow of the spray of pressurised water from the assembly (51) of nozzles when the temperatures measured by the thermocouples (53) are decreasing at a rate lower than the reference temperatures. Conversely, the flow control unit (54) decreases the mass flow of the spray of pressurised water from the assembly (51) of nozzles when the temperatures measured by the thermocouples (53) are decreasing at a rate higher than the rate of decrease of the reference temperatures. The time for which the assembly (51) of nozzles releases a spray of pressurised water onto the workpiece (52) is also controlled by the flow control unit (54) according to the temperatures measured by the thermocouples (53). When the measured temperatures indicate that the workpiece (52) is cooled to the desired temperature—in this embodiment, when the workpiece (52) has been cooled uniformly to 300° C.—the flow control unit (54) ceases the spray of pressurised water onto the workpiece (52).

[Step (C)]

With reference once more to FIG. 3, at step (C), a part is formed from the workpiece in a cold die set. In this embodiment, the part is also held under pressure in the die set to cool it further.

In this embodiment, the dies are shaped to account for local thinning of the workpiece. Before manufacture of the dies, simulation is used to refine the planned surface geometries of the dies according to the thickness of the part to be formed in the dies, including local thinning. In existing methods, the die surface is designed and machined based on the assumption that the sheet to be formed by the dies will be uniformly thick. For example, the die surface is designed and machined for a sheet of nominal sheet thickness plus 10% for tolerance. By contrast, in this embodiment, the tool surfaces are shaped to follow the thickness contours of the formed part. This increases the contact between the workpiece and the die in order to improve the heat conductance to the die.

[Step (D)]

At step (D), the dies are released. Once the part has cooled to a sufficiently low temperature—in this embodiment, it is cooled to about 100° C.—it is removed.

The final strength of the component is then enhanced after the forming process by artificial ageing (not shown in FIG. 3).

[Effects and Advantages]

Compared to the existing HFQ (RTM) process, the advantages of this method may be summarized as follows:

(i) The lower forming temperature results in lower die temperatures and less intensive thermal cycles, increasing die life.

(ii) Less heat is transferred to the dies. In many embodiments, natural convection/conduction is sufficient to cool the workpiece in the dies and the need for die cooling is eliminated. This can simplify die set design and decreases costs. For example, in aerospace applications, parts are typically formed slowly (productivity is low) and so the natural die cooling of the workpiece will be sufficient.

(iii) Holding pressures and times of the formed part in the dies are lower due to the smaller temperature change required, decreasing energy usage and increasing productivity.

(iv) Since the strain hardening effect is greater at lower temperatures, parts can be formed at a lower speed than in the existing HFQ (RTM) process. Standard mechanical presses can therefore be used for forming.

(v) This lower forming speed can reduce the impact loading on the dies, increasing die life.

(vi) The greater strain hardening effect at lower temperatures can lead to higher drawability of the workpiece in the die and hence improved formability. Combined with the good ductilities achieved after solution heat treating (with true strains to failure (cf) in the range of 30% to 60%; i.e. comparable to that of mild steel), complex-shaped parts may be formed, even at the lower forming temperature. (vii) In embodiments where the workpiece is cooled non-uniformly at step (B), the temperature over different areas of the workpiece can be varied as required to maximize formability and reduce localized thinning.

Figure 2A:
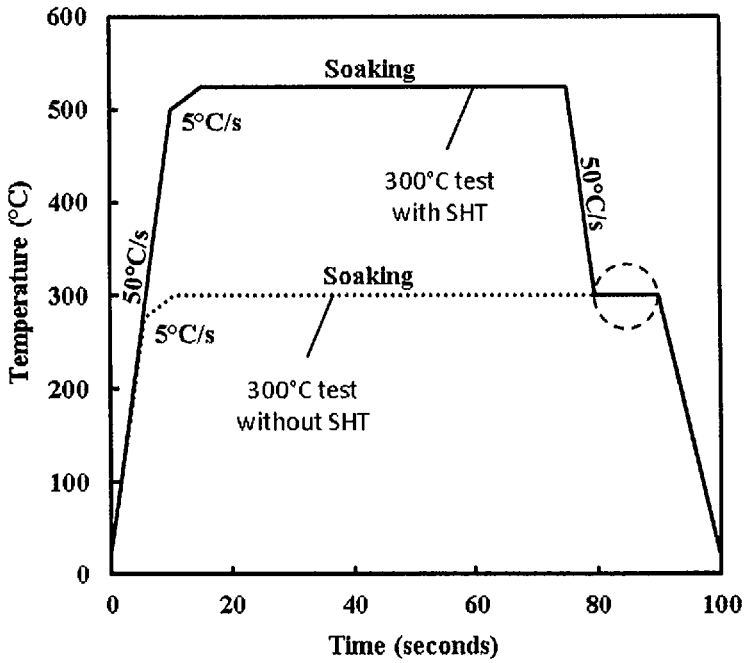
FIG. 2(*a*) shows temperature histories used for uniaxial tensile tests on a sheet of metal alloy at 300° C. with and without prior SHT.
Figure 2B:
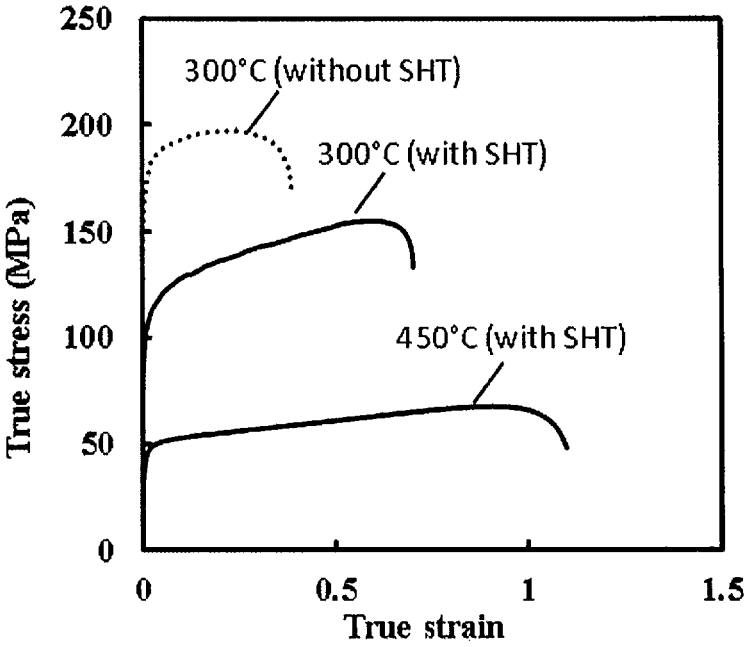

With reference now to FIGS. 2(*a*) and 2(*b*), a brief discussion will now be made of the effects on the mechanical properties of a workpiece of SHT (step (A)) and of the cooling stage (B).

Uniaxial tensile tests were carried out on Aluminium alloy at 300° C., with and without prior SHT. FIG. 2(*a*) shows the temperature histories used for these tests. The circled region indicates when the specimen was deformed. FIG. 2(*b*) shows the results of the uniaxial tensile tests on the alloy with the test conditions shown in FIG. 2(*a*). It therefore shows a comparison of the mechanical behaviour of the alloy with and without SHT. It also shows the results of tests on the alloy at 450° C. with prior SHT (the conventional HFQ (RTM) process).

The deformation behaviour of the material tested to failure at different temperatures was compared to the deformation of the material when tested after rapid cooling from the SHT temperature to the same temperatures. This would reveal the benefits of prior SHT to the mechanical properties. Tests were conducted at a strain rate of 1/s, with the rolling direction parallel to the loading direction. Also compared are the results for a test conducted at HFQ (RTM) conditions, assuming that after solution heat treating (at the SHT temperature) and transferring to the cold die set, the workpiece temperature before deformation is 450° C. This would reveal the benefits of introducing the cooling step to the conventional HFQ (RTM) process.

It can be seen from FIG. 2(*b*) that the ductility of a workpiece with prior SHT is enhanced compared to when there is no prior SHT. It reaches a sufficient level for the forming of complex features. Deformation at 300° C. with prior SHT increased the ductility by approximately 80%. When compared to HFQ (RTM) conditions, strain hardening was enhanced. By assuming a power law representation of the data, it was found that the strain-hardening exponent (n-value) increased from 0.04 to 0.12. It can also be seen that the flow stress is much higher compared to HFQ (RTM) conditions. The tensile strength under deformation at 300° C. is over two times greater than that achieved at HFQ (RTM) conditions. It can therefore be seen that the cooling step enhances strain hardening and strength, while sufficient ductility is maintained for the forming of complex-shaped parts, hence improving the sheet metal formability. As can also be seen from the results shown in FIG. 2(*b*), from the comparison of the flow stress curves of 300° C. with SHT and 450° C. with SHT, the strain hardening effect is more pronounced at 300° C. Therefore, if a part is formed at 300° C., the thickness distribution in the part will be more uniform than for a part formed at 450° C.

[Step (B)—Alternatives]

With reference once more to FIG. 3, in alternative embodiments, the cooling step (B) is carried out differently to the manner described above. In other respects, the process may be the same as the process of the first embodiment. These alternative embodiments will now be described.

[Alternative Uniform Cooling by Mist Spray]

In one alternative embodiment, the workpiece is not placed on a surface at a cooling station, but is cooled by a mist of air and water (as described above) while it is held in grips during transfer from the furnace to the dies. In other embodiments, the workpiece continues to be cooled by a mist of air and water once it has been transferred to the dies. This is achieved by nozzles built into the die set which, as described above, release pressurised water as a fine spray. In still other embodiments, the workpiece is only cooled once it has been transferred to the dies. In some embodiments in which the workpiece is cooled once it has been transferred to the dies, the air-water mist is used to cool and clean the dies.

[Uniform Cooling by Air Stream]

In other embodiments, the workpiece is cooled by a controlled stream of air from an assembly of air blades. In some embodiments, this is performed at a cooling station between the furnace and the dies, at which the workpiece is laid on a surface and cooled by the stream of air. In others, it is cooled while it is being transferred between the furnace and the dies, while it is held in the grips used to transfer it.

[Uniform Cooling by Conductive Plates]

Figure 6:
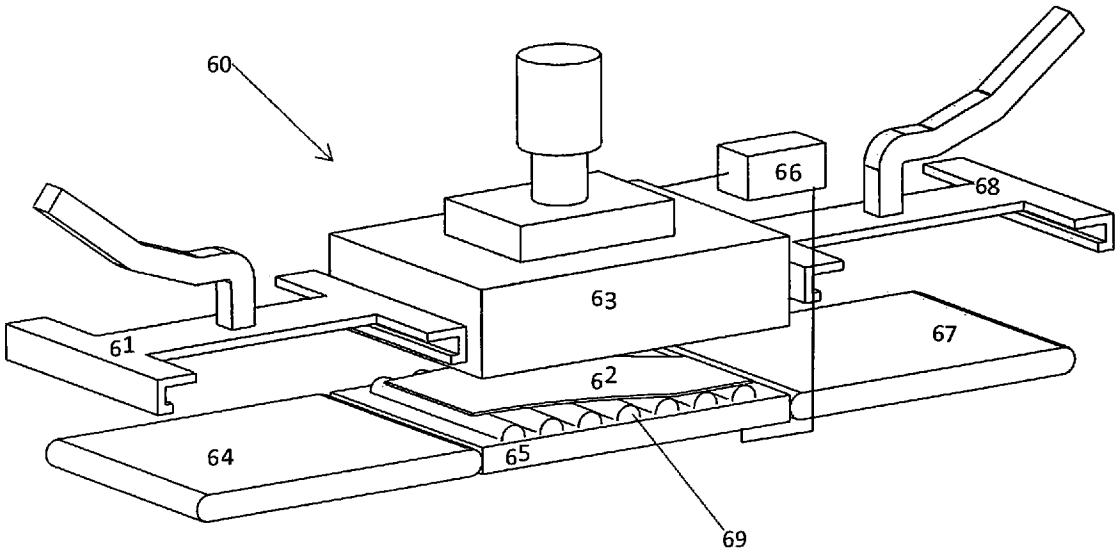
FIG. 6 shows a workpiece at a cooling station with conductive plates in the form of upper and lower quenching blocks.

With reference now to FIG. 6, in yet other embodiments, the workpiece (52) is cooled using conductive plates in the form of an upper quenching block (63) and lower quenching block (65). As with the embodiments in which the workpiece is cooled using a mist of air and water or by air blades, the workpiece can be cooled using conductive plates either at a cooling station on a production line between the furnace and dies, or during transfer between the furnace and dies. In both embodiments, the workpiece is held between conductive plates and uniform pressure is applied until it is cooled to the desired temperature.

In this alternative embodiment, the workpiece (52) is cooled at a cooling station (60) on a production line (not shown) between the furnace and dies (also not shown). A placing robot (61) picks up the workpiece (52) after step (A) (solution heat treating of the workpiece) has been performed. The placing robot (61) deposits the workpiece (52) on a loading conveyor (64). The loading conveyor (64) rolls the workpiece (52) onto rollers (69) of the lower quenching block (65). These rollers (69) are retractable, and once the workpiece (52) is in place beneath the upper quenching block (63), the rollers (69) retract. The upper quenching block (63) is then lowered onto the workpiece (52). The pressure applied by the upper quenching block (63) is regulated by a pressure control unit (66). In general, the greater the pressure that is applied, the faster the cooling rate of the workpiece (52). Cooling in this way between quenching blocks under load allows for a cooling rate of over 500° C. per second. In this embodiment, therefore, the cooling time between the blocks (63), (65) is less than 0.5 s. Even faster cooling, however, can also be achieved. For example, a cooling time of 0.1 s is possible with this apparatus.

In another alternative embodiment, the temperature of the workpiece (52) is monitored with thermocouples (not shown), in the same manner as in the embodiment described in relation to FIG. 5. The pressure control unit (66) in this alternative embodiment operates in a manner similar to the flow control unit (54) described above. Specifically, the pressure control unit (54) compares the temperatures measured by thermocouples (53) with reference temperatures. The pressure control unit (54) increases the pressure applied to the workpiece (52) by the upper quenching block (63) when the temperatures measured by the thermocouples (53) are decreasing at a rate lower than the reference temperatures. Conversely, the pressure control unit (54) decreases the pressure applied to the workpiece (52) by the upper quenching block (63) when the temperatures measured by the thermocouples (53) are decreasing at a rate higher than the reference temperatures. The time for which the pressure is applied by the upper quenching block is also controlled by the flow control unit (54) according to the temperatures measured by the thermocouples (53). When the measured temperatures indicate that the workpiece (52) is cooled to the desired temperature—in this embodiment, when the workpiece (52) has been cooled uniformly to 300° C.—the pressure control unit (56) causes the upper quenching block (63) to be lifted from the workpiece (52).

In both of the alternative embodiments just described, after the workpiece (52) has been cooled for a particular period of time (or, in the second embodiments, to a particular measured temperature), the upper quenching block (63) is lifted from the workpiece (52). The rollers (69) of the lower quenching block (65) are then re-extended and roll the workpiece (52) onto the unloading conveyor (67). The unloading conveyor (67) positions the workpiece (52) such that it can be lifted by the transfer robot (68). The transfer robot (68) transfers the workpiece (52) to the dies (not shown) for step (C).

[Cooling on a Vacuum Plate]

Figure 4:
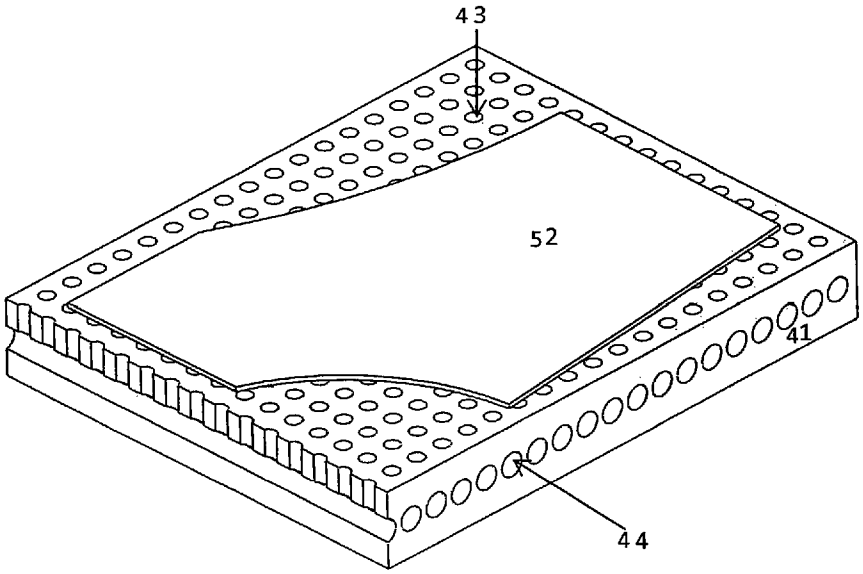
FIG. 4 shows a schematic view of a sheet of metal alloy (a workpiece) on a conductive cooling plate with vacuum ducts.

With reference now to FIG. 4, a further alternative embodiment in which the workpiece (52) is cooled by conductive plates will now be described. FIG. 4 shows a workpiece (52) on a plate (41) with a high thermal conductivity. The plate (41) is connected via channelling (44) in the side of the plate (41) to a vacuum unit (not shown). The channelling (44) connects to ducts (43) having openings in the surface of the plate (41) on which the workpiece (52) is placed during cooling. In an embodiment, this plate (41) replaces the lower quenching block (65) of the embodiment described above with reference to FIG. 6. In this embodiment, the workpiece (52) is placed on the plate (41). The upper quenching block (63) is lowered onto the workpiece (52). A vacuum is created in the ducts (43). This sucks the workpiece (52) onto the plate (41). It thereby increases the pressure experienced by the workpiece (52). The vacuum also increases airflow around the workpiece (52), which increases the cooling rate. Once the workpiece (52) has been cooled to a particular temperature as measured by thermocouples (in this embodiment, 300° C.) or has been cooled for a particular time (where thermocouples are not present), the vacuum is no longer applied, and the process continues as described above with reference to FIGS. 6 and 3.

In another alternative embodiment, the workpiece is cooled on the plate (41) with a high thermal conductivity, as described above. A bimetallic strip (not shown in FIG. 4) lifts the workpiece (52) away from the plate (41) when the workpiece reaches a defined temperature. In this alternative embodiment, therefore, the cooling step is terminated by the bimetallic strip, without the need for a control unit or human intervention. A bimetallic strip can also be used to lift the workpiece (52) away from a lower quenching block (or plate with high thermal conductivity) where that block is not arranged to have a vacuum through it.

[Non-uniform Cooling]

In another alternative embodiment, areas of the workpiece where a greater strain hardening effect will be required to form the part are cooled to a lower temperature than the rest of the workpiece ("non-uniform cooling"). In some "non-uniform cooling" embodiments, which areas are selectively cooled is determined by the geometry of the part to be formed from the workpiece. For example, the temperature of an area of the workpiece which is to be formed to have small features, which require significant material stretching, will be selected to be slightly lower than the temperature of other areas on the workpiece, so that during forming, material draw-in can take place to reduce localized thinning. In other words, imparting a non-uniform temperature across the workpiece is used in order to gain additional control over material movement in the die.

In other "non-uniform cooling" embodiments, which areas are selectively cooled is determined by the forces that that part is predicted to experience in use. For example, areas that should sustain high stresses with relatively low ductility would be quenched at a fast rate, on the other hand, areas that should have good ductility with lower yield stresses may be cooled at a lower rate.

In yet other "non-uniform cooling" embodiments, the workpiece is cooled such that its temperature at the end of the cooling step (B) varies smoothly between regions of the workpiece. In other words, the cooled workpiece has multiple temperature gradients across it. This produces several distinct temperature regions on the workpiece. Cooling is controlled in this way, for example, to deliver graduated strength over the workpiece. Where the workpiece is for an automotive part, such cooling can provide for controlled failure of the part under crash conditions.

In further "non-uniform cooling" embodiments, when the workpiece has more than one thickness of material—for example, when the workpiece is a tailor welded blank (that is, a workpiece made up of two or more sheets welded together), thinner areas of the workpiece are cooled to a lower temperature than the thicker areas of the workpiece. This facilitates straining of the thicker areas, thus reducing strain in the thin sections. In this way, the strain is distributed more evenly between the thick and thin material, and, the maximum thinning in a critical area is reduced.

[Non-uniform Cooling by Conductive Plates]

In one "non-uniform cooling", embodiment, the workpiece is cooled by conductive cooling in a similar manner to the "uniform cooling" embodiment described above in relation to FIG. 6. That is, it is cooled between upper and lower quenching blocks at a cooling station on a production line between the furnace and the dies. In this embodiment, however, the upper quenching block is modified so that cooling to different temperatures on different areas of the workpiece is achieved by increasing the pressure of the block on the workpiece in areas where the workpiece is to be cooled to a lower temperature. The upper quenching block in this embodiment has embossed areas corresponding to areas on the workpiece where a greater rate of cooling is required. When the upper quenching block is applied to the workpiece, the pressure of these embossed areas on the workpiece is greater than the pressure of the unembossed areas. The workpiece is thereby cooled at a greater rate where it is in contact with the embossed areas than in the region of the unembossed areas.

In another "non-uniform cooling" embodiment, the workpiece is also cooled by conductive cooling in a similar manner to the "uniform cooling" embodiment described above in relation to FIG. 6. In this embodiment, however, the upper quenching block is modified so that it is only applied to those areas of the workpiece which are to be cooled to a lower temperature.

In yet another "non-uniform cooling" embodiment, the workpiece is also cooled by conductive cooling in a similar manner to the "uniform cooling" embodiment described above in relation to FIG. 6, but the upper quenching block is made from materials with different thermal conductivities. In areas of the upper quenching block corresponding to areas of the workpiece which are to be cooled at a greater rate than other areas of the workpiece, the upper quenching block is made from a material which has a higher thermal conductivity than the other areas of the quenching block. In areas of the upper quenching block corresponding to areas of the workpiece which are to be cooled at a lower rate, the upper quenching block is formed of a material with a lower thermal conductivity.

In a variation on each of the above-described embodiments, the lower quenching block is instead modified as described above in relation to the upper quenching block. The upper quenching block in these variations like the one described in relation to FIG. 6.

In further "non-uniform cooling" embodiments, the workpiece is cooled on a plate (41) through which a vacuum is created, as shown in FIG. 4, with the upper quenching block (not shown) modified in any of the ways described above.

In a yet further "non-uniform cooling" embodiment, the workpiece is cooled on a plate (41) through which a vacuum is created, as shown in FIG. 4, and the vacuum is used to create different negative gauge pressures on the workpiece in different areas of the workpiece. That is, the level of the vacuum is increased through those of the ducts (43) situated beneath areas of the workpiece (52) which is to be cooled at a higher rate than the rest of the workpiece. This increases the force with which those areas are held against the plate (41), and thus increases the rate of cooling of those areas. The vacuum is weaker through those of the ducts (43) situated beneath areas of the workpiece (52) which are to be cooled at a lower rate.

"Non-uniform cooling" using conductive plates, as described above, is conducted, in other embodiments, while the workpiece is held in grips during transfer between the furnace and dies (rather than at a cooling station).

[Non-uniform Cooling by Mist Spray]

In a similar manner to the uniform cooling of the workpiece using a mist of air and water, described above in relation to FIG. 5, the assembly (51) of nozzles releasing pressurised water as a spray is used, in an alternative embodiment, to achieve non-uniform cooling. In this alternative embodiment, the flow control unit (54) causes only the nozzles in the region of areas of the workpiece which are to be cooled at a higher rate to release streams of air and water mist. This cools those areas of the workpiece more rapidly, and to a lower temperature than areas of the workpiece at which the nozzles are not directing air and water mist.

Alternatively or in addition, in another embodiment, the flow control unit (54) controls the mass flow of the air and water mist from each of the nozzles so that the nozzles in the region of areas of the workpiece which are to be cooled more rapidly release air and water mist at a higher mass flow than nozzles in other areas. Similarly, the flow control unit (54) in that other embodiment, controls the nozzles in the region of areas of the workpiece which are to be cooled to a lower temperature to release air and water mist for a longer time than nozzles in other regions of the workpiece.

The invention claimed is:

1. A method of forming a part of complex shape from sheet 7XXX alloy, the method comprising the sequential steps of:

(a) heating the sheet to a temperature at which solution heat treatment of the alloy occurs so as to achieve solution heat treatment;

(b) measuring the temperature of the sheet at one or more positions on the sheet and cooling the sheet by controlling the cooling rate of the sheet to at or above the critical cooling rate of the alloy until a target temperature is reached based on the measured temperature at the one or more positions, wherein the target temperature is 50° C. to less than 450° C.; and then (c) placing the sheet between dies to form it into or towards the complex shape, wherein the sheet is of an AA7XXX aluminium alloy, and step (a) comprises heating the sheet to between 460° C. and 520° C.

2. The method of claim 1, wherein step (b) comprises cooling the sheet at at least the rate at which microstructural precipitation in the alloy is avoided.

3. The method of claim 1, wherein the sheet is cooled to the lowest temperature that still allows forming of the part.

4. The method of claim 1, wherein step (b) comprises applying a cooling medium to the sheet.

5. The method of claim 4, wherein the cooling medium is a solid.

6. The method of claim 5, wherein step (b) comprises applying a load to the solid to increase the pressure of the solid on the sheet.

7. The method of claim 5, the solid comprising a surface arranged to be in contact with the sheet, at least one first area of that surface being in relief relative to at least one second area.

8. The method of claim 4, wherein the cooling medium is a fluid.

9. The method of claim 1, wherein step (b) comprises selectively cooling at least a first area of the sheet to a first temperature which is lower than a second temperature, to which at least a second area of the sheet is cooled.

10. The method of claim 9, wherein step (b) comprises selectively cooling at least a first area of the sheet to a first temperature which is lower than a second temperature to which at least a second area of the sheet is cooled by applying a solid cooling medium with greater pressure to the first area than to the second area.

11. The method of claim 9, wherein step (b) comprises selectively cooling at least a first area of the sheet to a first temperature which is lower than a second temperature to which at least a second area of the sheet is cooled by applying a solid cooling medium to the first area and not to the second area.

12. The method of claim 9, wherein step (b) comprises selectively cooling at least a first area of the sheet to a first temperature which is lower than a second temperature to which at least a second area of the sheet is cooled by directing a fluid at the first area of the sheet with a longer duration, lower temperature and/or greater mass flow than at the second area.

13. The method of claim 1, wherein step (a) comprises heating the sheet to above the solution heat treatment temperature and maintaining the sheet at the solution heat treatment temperature for at least 15 seconds.

14. The method of claim 1, wherein the dies are cooled.

15. The method of claim 1, wherein step (b) comprises cooling the sheet at a cooling station forming part of an apparatus arranged to transfer the sheet to the dies.

16. The method of claim 1, wherein the target temperature is 50° C. to 350° C.

17. The method of claim 1, wherein the target temperature is 50° C. to 300° C.

18. A method of forming a part of complex shape from sheet metal alloy, the method comprising the sequential steps of:

(a) heating the sheet to a temperature at which solution heat treatment of the alloy occurs and so as to achieve solution heat treatment;

(b) cooling the sheet at at least the critical cooling rate for the alloy, including selectively cooling at least a first area of the sheet to a first temperature which is lower than a second temperature to which at least a second area of the sheet is cooled by applying a solid cooling medium with greater pressure to the first area than to the second area; and then (c) placing the sheet between dies to form it into or towards the complex shape.

19. A method of forming a part of complex shape from sheet 6XXX or 7XXX alloy, the method comprising the sequential steps of:

(a) heating the sheet to a temperature at which solution heat treatment of the alloy occurs so as to achieve solution heat treatment;

(b) measuring the temperature of the sheet at one or more positions on the sheet and cooling the sheet by controlling the cooling rate of the sheet to at or above the critical cooling rate of the alloy until a target temperature is reached based on the measured temperature at the one or more positions, wherein the target temperature is 50° C. to less than 450° C.; and then (c) placing the sheet between dies to form it into or towards the complex shape, wherein step (b) comprises selectively cooling at least a first area of the sheet to a first temperature which is lower than a second temperature to which at least a second area of the sheet is cooled by applying a solid cooling medium with greater pressure to the first area than to the second area.

* * * * *